US006762379B1

(12) United States Patent
Su

(10) Patent No.: US 6,762,379 B1
(45) Date of Patent: Jul. 13, 2004

(54) MICRO SWITCH

(75) Inventor: Jian-Hao Su, Hsin-Tien (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 10/408,452

(22) Filed: Apr. 8, 2003

(51) Int. Cl.[7] ..... H01H 13/28; H01H 13/52

(52) U.S. Cl. ..... 200/276.1; 200/61.82; 200/534; 337/66

(58) Field of Search ..... 337/66, 56, 20, 337/37, 52, 53, 55, 59, 112, 113, 348; 200/61.62–61.83, 276, 276.1, 520–535

(56) References Cited

U.S. PATENT DOCUMENTS

| | | | | | |
|---|---|---|---|---|---|
| 3,410,975 | A | * | 11/1968 | Voland | 200/276.1 |
| 3,944,768 | A | * | 3/1976 | Aryamane et al. | 200/453 |
| 4,015,094 | A | * | 3/1977 | Gavagan et al. | 200/61.58 B |
| 4,072,841 | A | * | 2/1978 | Corfield | 200/332 |
| 4,092,503 | A | * | 5/1978 | Raeder | 200/5 A |
| 4,169,974 | A | * | 10/1979 | Peers-Trevarton | 200/276 |
| 4,488,018 | A | * | 12/1984 | Hayashida | 200/6 R |
| 4,684,775 | A | * | 8/1987 | Oba | 200/276.1 |
| 4,698,465 | A | * | 10/1987 | Oba | 200/16 F |
| 4,831,253 | A | * | 5/1989 | Omura et al. | 250/229 |
| 4,937,407 | A | * | 6/1990 | Osika | 200/302.3 |
| 5,448,032 | A | * | 9/1995 | Wagatuma | 200/534 |
| 5,717,177 | A | * | 2/1998 | Tsai et al. | 200/16 R |
| 5,912,445 | A | * | 6/1999 | Takedomi | 200/276.1 |
| 5,913,415 | A | * | 6/1999 | Kishi et al. | 200/456 |

FOREIGN PATENT DOCUMENTS

| | | | | | |
|---|---|---|---|---|---|
| EP | 1261002 | A1 | * | 11/2002 | H01H/21/28 |
| JP | 07147115 | A | * | 6/1995 | H01H/13/52 |
| JP | 10188726 | A | * | 7/1998 | H01H/13/28 |
| JP | 2000164077 | A | * | 6/2000 | H01H/23/30 |
| JP | 2000306468 | A | * | 11/2000 | H01H/3/04 |
| TW | 517254 | | | 1/2003 | |
| WO | 200237517 | A1 | * | 5/2002 | H01H/13/52 |

* cited by examiner

*Primary Examiner*—Anatoly Vortman
(74) *Attorney, Agent, or Firm*—Birch, Stewart, Kolasch & Birch, LLP

(57) ABSTRACT

A micro switch is disclosed in the invention, which provides a micro switch that can increase the activation interval of pushbutton as well as can be assembled and manufactured easily. Besides, a round hole is provided at two sides of the main body corresponding to the pivot point of pushbutton, and a place-in slot is provided extending from the round hole to the opening end of acceptance room. In addition, a gap is provided on the sidewall of the main body adjacent to the round hole, extending to the opening end of acceptance room. Moreover, a guiding slanting face is formed at the lower edge of pivot point of pushbutton; therefore, through flexible force formed by the gap and through the guiding slanting face that makes it easy for the pivot point to be conjoined to the round hole, a micro switch having a longer activation interval is then formed.

7 Claims, 6 Drawing Sheets

MICRO SWITCH

FIELD OF THE INVENTION

The invention relates to a micro switch and, more particularly, to a micro switch having bi-directional operation to switch on/off the electrical contact point.

BACKGROUND OF THE INVENTION

A conventional small-sized micro switch with bi-directional operation is known to be more easily for use if the activation interval (an interval from activating the electrical contact point to deactivating the same) of its pushbutton can be longer. Therefore, when making a micro switch, the manufacturers will set the pivot point of the pushbutton at the endmost portion of the main body. Then, the operation portion of the pushbutton, which is used to press the resilient element downwards to a contact portion, is provided at the opposite side of the pivot point. Therefore, the length of activation interval is determined by how the pivot point of pushbutton is located. As for positioning the pivot point of pushbutton, a positioning element can be scaled inside the concave portion at an opening end's edge on the main body so that the pushbutton can be prevented from detaching.

On the other hand, in order to improve the problems of high cost in positioning element and assembling labor caused by the positioning method of pushbutton's pivot point, a solution is proposed; that is, a semicircle-shaped hole is provided, which is formed by an arc edge and a straight-lined edge capable of free rotating to support the pivot axis of pushbutton and is located at two sides of the main body of micro switch. Then, the pivot axis of pushbutton will be coaxial to the semicircle-shaped hole at two sides of the pushbutton. After that, a fan-shaped protrusion is provided, which is smaller than the open angle of semicircle-shaped hole, and the fan-shaped protrusion is embedded in the semicircle-shaped hole to form a micro switch that can save the cost of a positioning element. Unfortunately, there are still other problems involved with the micro switch, which are discussed as below:

1. The length of activation interval is subjected to the size of fan-shaped protrusion and semicircle-shaped hole that should be matched to each other. If the angle formed by the fan-shaped axis has been diminished, the activation interval of pushbutton can then be lengthened. However, the diminishing action will lower the assembling force necessary for the fan-shaped protrusion to be embedded into the semicircle-shaped hole, which eventually will make the pushbutton prone to be detached more easily when the resilient element is restoring its resilience and pushing back upwardly. In addition, comparing to the semicircle-shaped hole, the rotating movement made by the fan-shaped protrusion can limit the activation interval more. Therefore, such improvement cannot actually increase activation interval.
2. In order to prevent from the above-mentioned detachment of pushbutton as well as to prevent the pushbutton from shaking, a brake element and a thin panel are provided on the main body and the pushbutton. However, since the volume of micro switch is very small itself, forming a brake element and thin panel does very little in reinforcing strength. Besides, degree of product precision is hard to be achieved because of small volume. Therefore, product yielding will not be good enough, and on the other hand, assembling cost might be increased since degree of product precision is hard to be controlled.

SUMMARY OF THE INVENTION

In viewing the above problems, the object of the invention is to provide a design that doesn't have to lengthen the activation interval of semicircle-shaped hole like what is done in the prior art; instead, a round hole is provided at two sides of the main body corresponding to the pivot point of pushbutton, and a place-in slot is provided extending from the round hole to the opening end of the acceptance room; besides, a gap is provided on the sidewall of main body adjacent to the round hole, extending to the opening end of the acceptance room; in addition, a guiding slanting face is formed at the lower edge of pivot point of pushbutton; therefore, through flexible force formed by the gap and through the guiding slanting face that makes it easy for the upper part of pivot point to be conjoined to the round hole in an embedding-in manner, a micro switch with longer activation interval is then completed.

Another object of the invention is to abandon the prior method of reinforcing positioning by utilizing a flat object such as a brake element and a thin panel applied in the prior art because the method is lacking good strength and good control in degree of product precision; instead, a confining portion is provided on another sidewall of main body opposite to the gap, and a top-ending portion is provided extending from the pushbutton corresponding to the confining portion. After the place-in face of top-ending portion has been smoothly conjoined to the confining portion, a positioning method by utilizing a press-top face as a block can effectively prevent the pushbutton from detaching when the pushbutton is pushed by the resilient element due to restoring resilience.

DESCRIPTION OF THE PREFERRED EMBODIMENTS

Figure 2A:
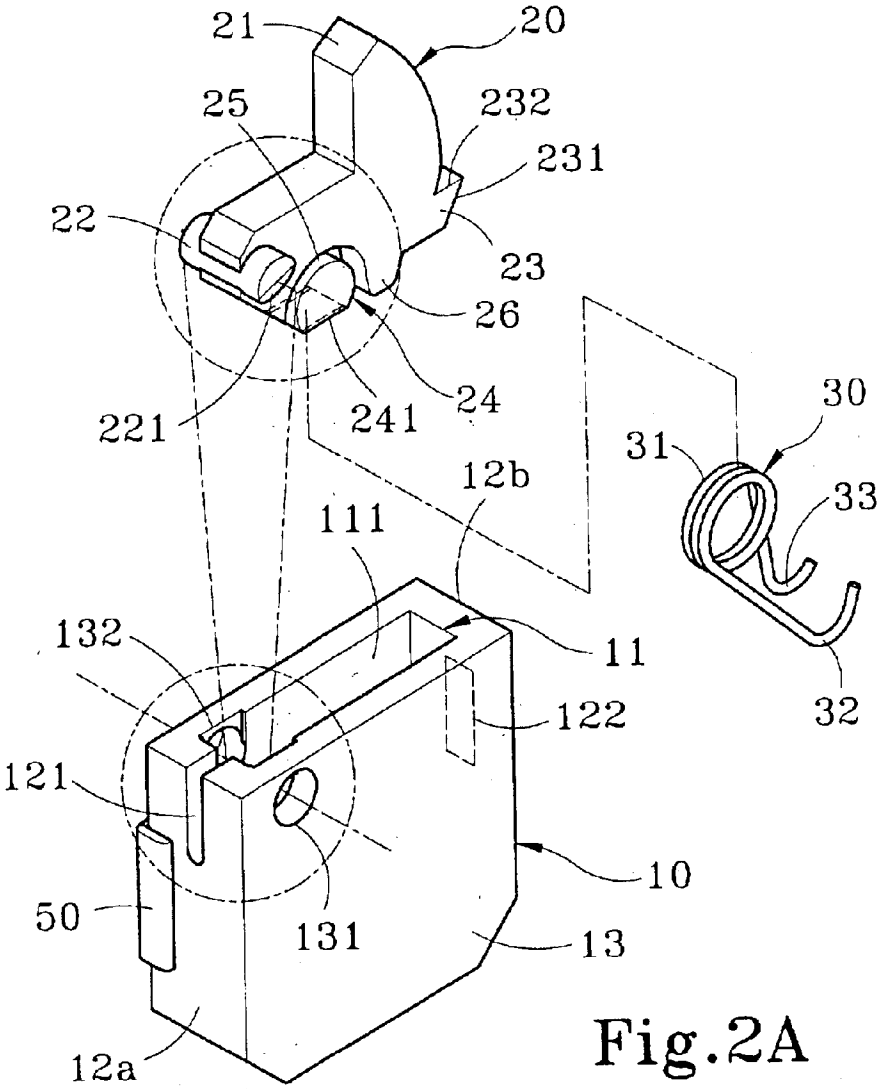
FIG. 2A is a schematic diagram showing an exploded view of the invention.
Figure 1:
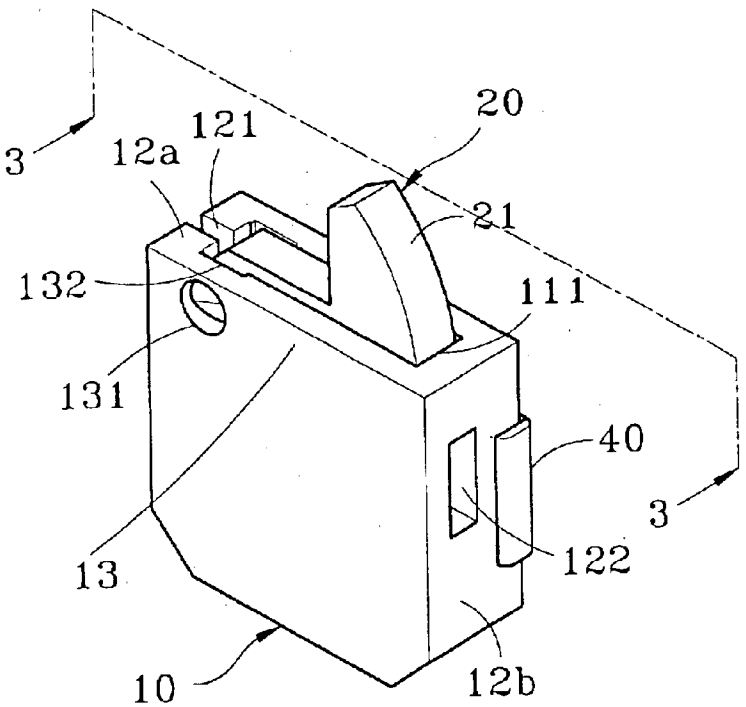
FIG. 1 is a perspective schematic diagram showing an external view of the invention.
Figure 2C:
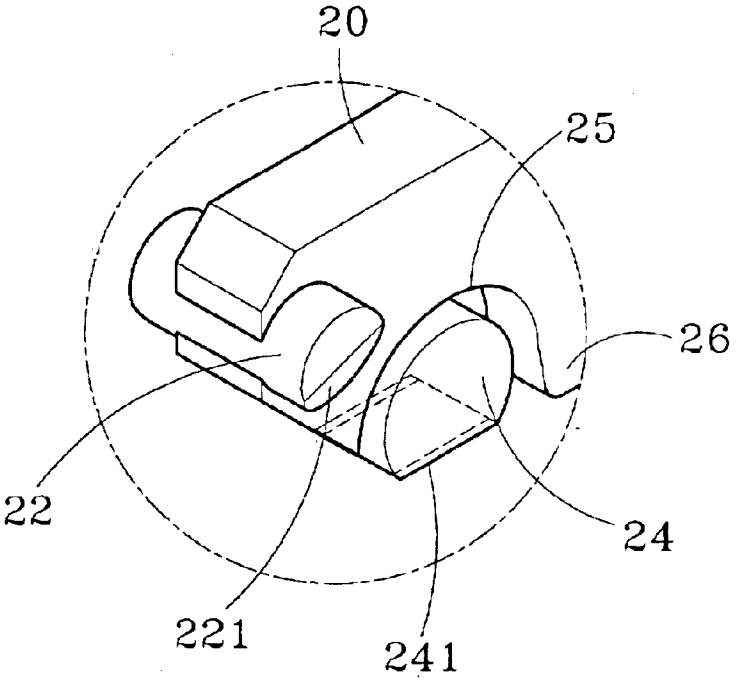
FIGS. 2B and 2C are schematic diagrams showing an enlarged view of partial structure of the invention.
Figure 2B:
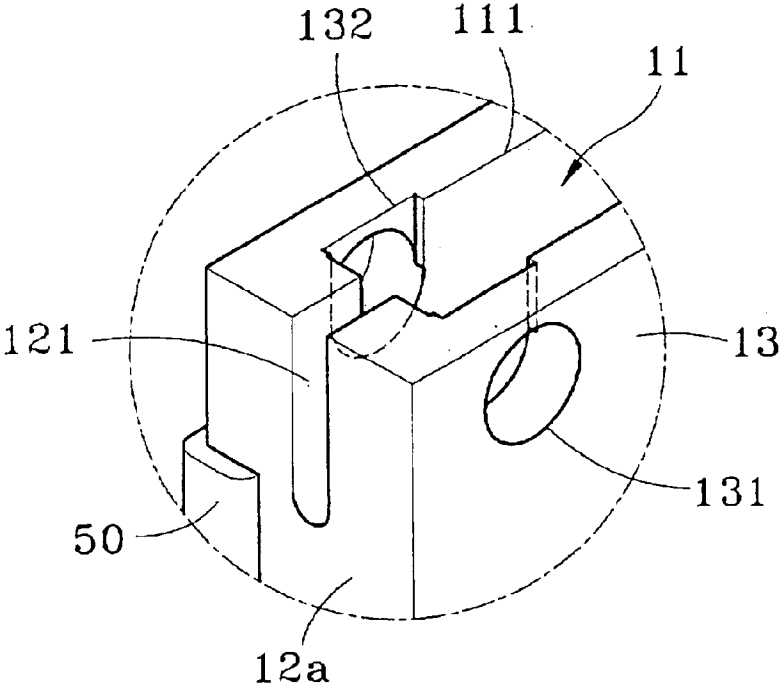

The technical contents of the invention will be described below with reference to the accompanied drawings.

FIGS. 1 and 2A–2C are schematic diagrams showing the external view and exploded view of the invention respectively. Referring to the Figs, the invention first includes a main body 10, wherein an acceptance room 11 is formed internally therein. Second, a first conductive terminal 40 and a second conductive terminal 50 are provided separately at each of the two side walls 12*a* and 12*b* of main body 10. Third, a pivot point 22 is provided in the acceptance room 11, wherein the pivot point 22 can be freely rotating to support the pushbutton 20 of main body 10. Fourth, a force-receiving portion 21 of pushbutton 20 is located at the lower side of pushbutton 20 to provide resilience capable of pushing up the pushbutton 20 protruding from the main body 10 to form the pushbutton 20. Fifth, a resilient element 30 of first and second conductive portions 32 and 33 contacts first and second conductive terminals 40 and 50 separately. Sixth, a round hole 131 is provided at two sides 13 of main body 10 corresponding to the pivot point 22 of pushbutton 20, and a place-in slot 132 is provided extending from the round hole 131 to the opening end 111 of the acceptance room 11. Seventh, a gap 121 is provided on the sidewall 12*a* of the main body 10 adjacent to the round hole 131, and the gap 121 is also extending to the opening end 111 of the acceptance room 11. Finally, a guiding slanting face 221 is formed at the lower edge of pivot point 22 of pushbutton 20; therefore, through flexible force formed by the gap 121 and through the guiding slanting face 221 that makes it easy for the pivot point 22 to be conjoined to the round hole 131, a micro switch having a longer activation interval is then formed.

Figure 4:
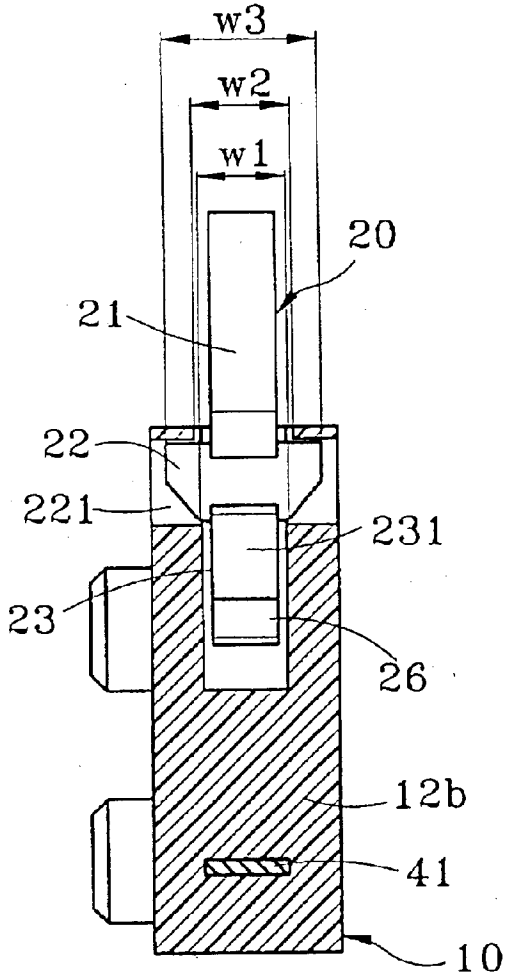
FIG. 4 is a schematic diagram showing sectional view of FIG. 3 cutting along the line 4—4.
Figure 3:
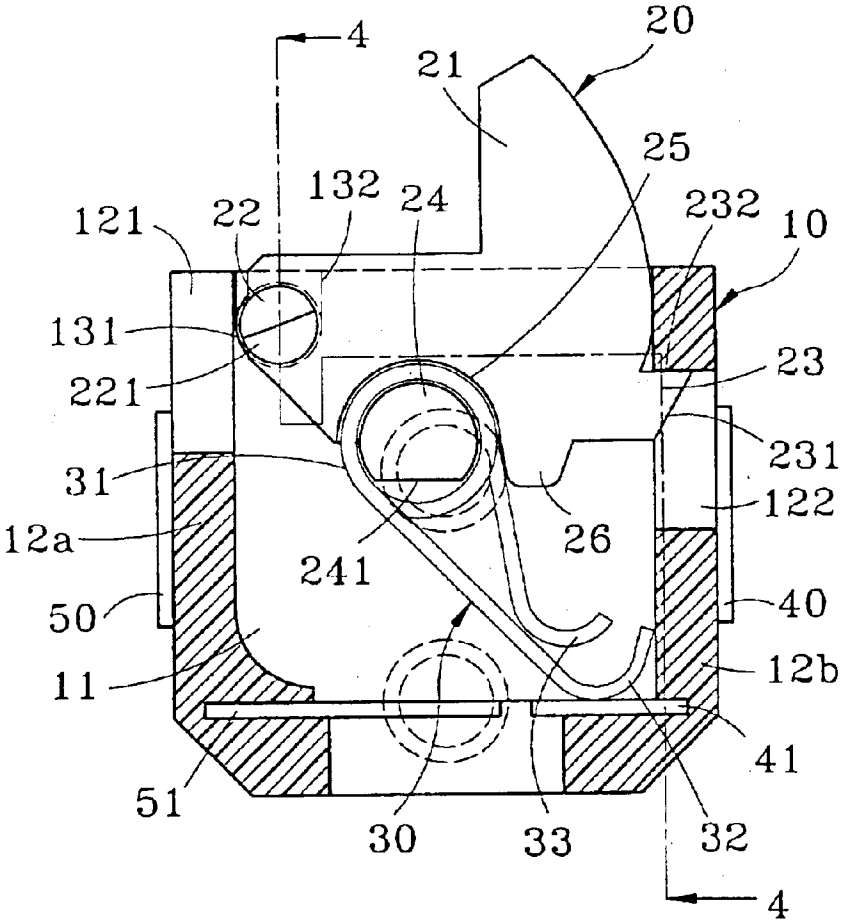
FIG. 3 is a schematic diagram showing sectional view of FIG. 1 cutting along the line 3—3.

Also, referring to FIGS. 3 and 4, when assembling the pushbutton 20 of the invention, the width of its pivot point 22 is defined as w2, the width of guiding slanting face 221 is defined as w1, and the width of place-in slot 132 is defined as w3, wherein the relation among them is w2>w3>w1. Thus, the design of invention is first to enter the place-in slot 132 through the guiding slanting face 221, wherein the place-in slot 132 of opening end 111 has flexible force capable of stretching by means of gap 121. Besides, the guiding slanting face 221 has a certain slope allowing the pushbutton 20 to be moving downwards to the pivot point 22 and then enter the round hole 131 without assistance from any tools as well as without destroying configuration of the main body 10. In addition, after the pivot point 22 has entered the round hole 131, the pushbutton 20 will not be easily detached because the width w2 of pivot point 22 is larger than the width w3 of place-in slot 132. Moreover, in order to reinforce the positioning effect for the pushbutton 20, a confining portion 122 is provided at the other sidewall 12*b* of main body 10 opposite to the gap 121. Also, a top-ending portion 23 is provided extending from the main body 10 corresponding to the confining portion 122, wherein the top-ending portion 23 includes a place-in face 231 and a press-top face 232, which will all move downwards when the pushbutton 20 is moving downward. Additionally, the place-in face 231 also has a design of slanting angle. After the top-ending portion 23 has entered the confining portion 122, the upper wall of confining portion 122 will block the press-top face 232 even though the pushbutton 20 is at a free state. Therefore, the positioning effect of pushbutton 20 can be enhanced.

Figure 5B:
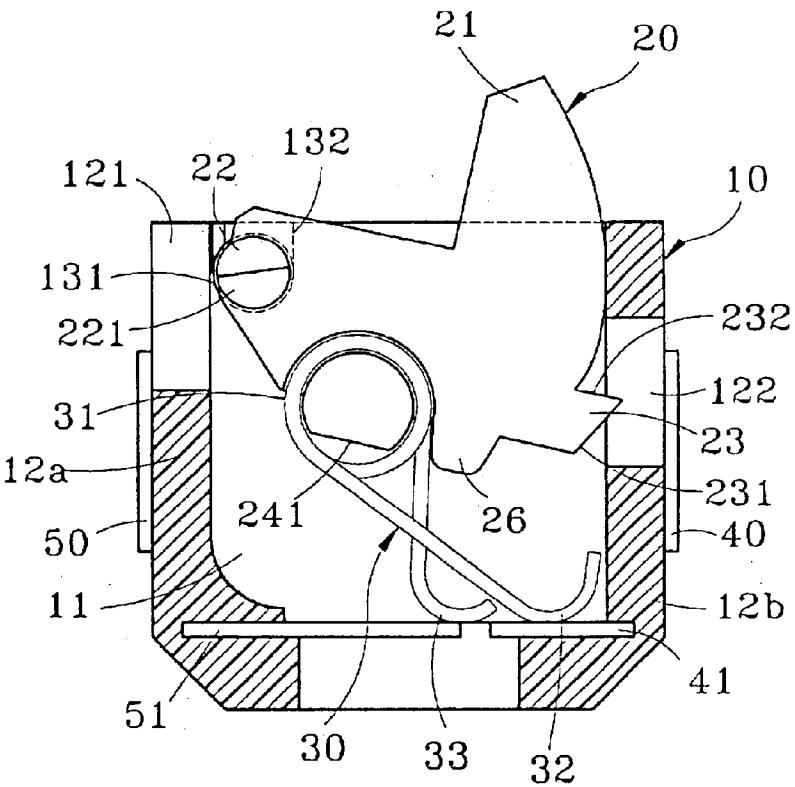
FIGS. 5A, 5B, and 5C are schematic diagrams showing activations of the invention when it is receiving force from left and vertical directions.
Figure 5A:
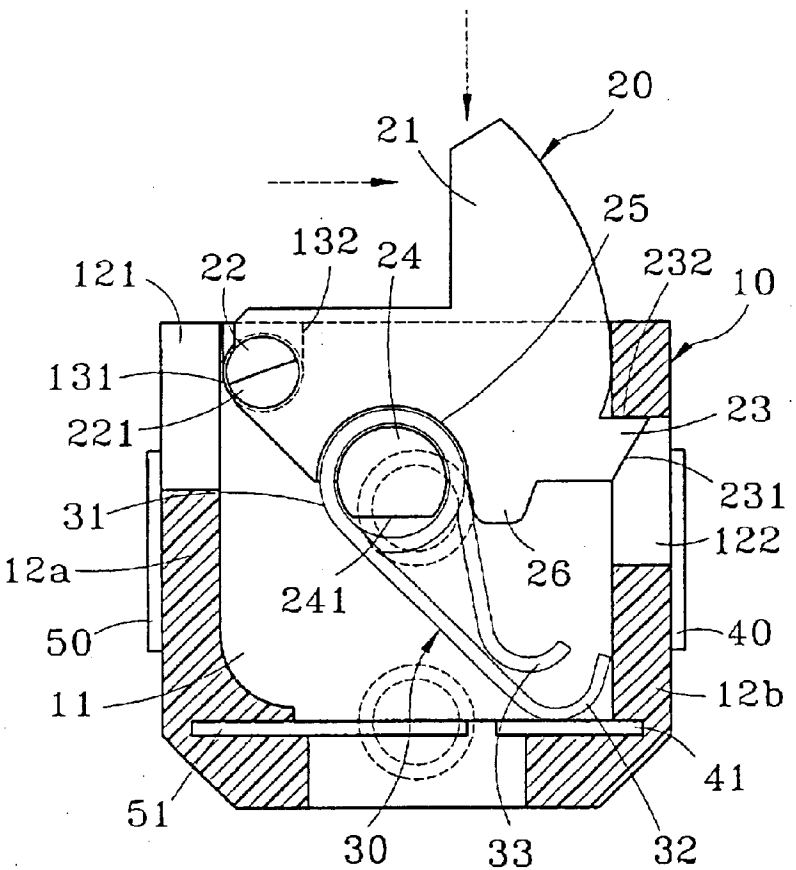
Figure 6A:
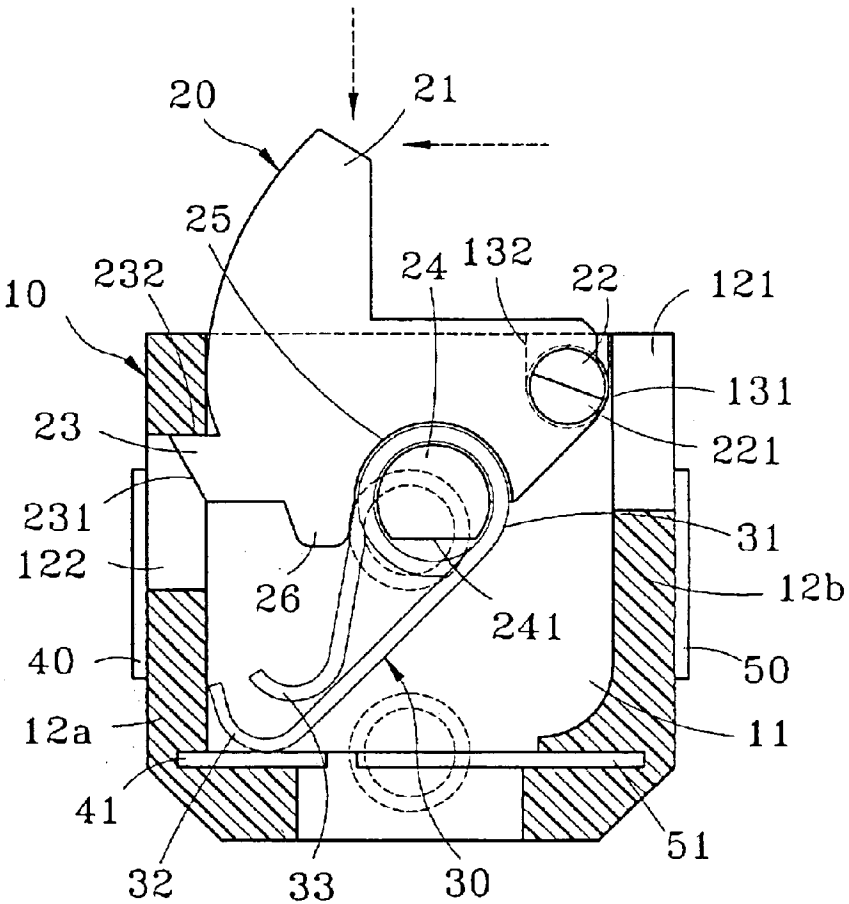
FIGS. 6A, 6B, and 6C are schematic diagrams showing activations of the invention when it is receiving force from right and vertical directions.

Next, FIGS. 5A and 6A are schematic diagrams showing the invention is activated when receiving external force. As shown in the Figs., the micro switch must be applicable to different mechanisms; that is, despite that the external force is coming from left, vertical or right direction, signal conduction of micro switch should be generated accordingly. Since all the elements of the invention are located inside the acceptance room 11 of the main body 10, the only thing needed to do is let the first conductive terminal 40 be opposite to the second conductive terminal 50 when they are provided on the sidewalls 12*a* and 12*b* of main body 10. Therefore, as long as the micro switch is turned over, the micro switch can then change the way of receiving external force from left and vertical directions (as shown in FIG. 5A) to right and vertical directions (as shown in FIG. 6A).

Figure 5C:
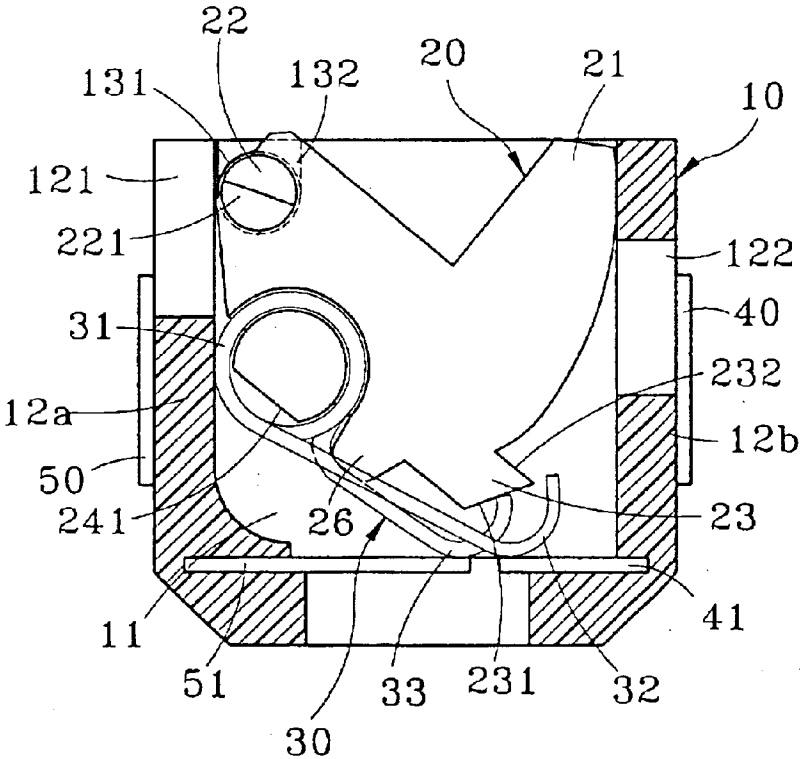
Figure 6C:
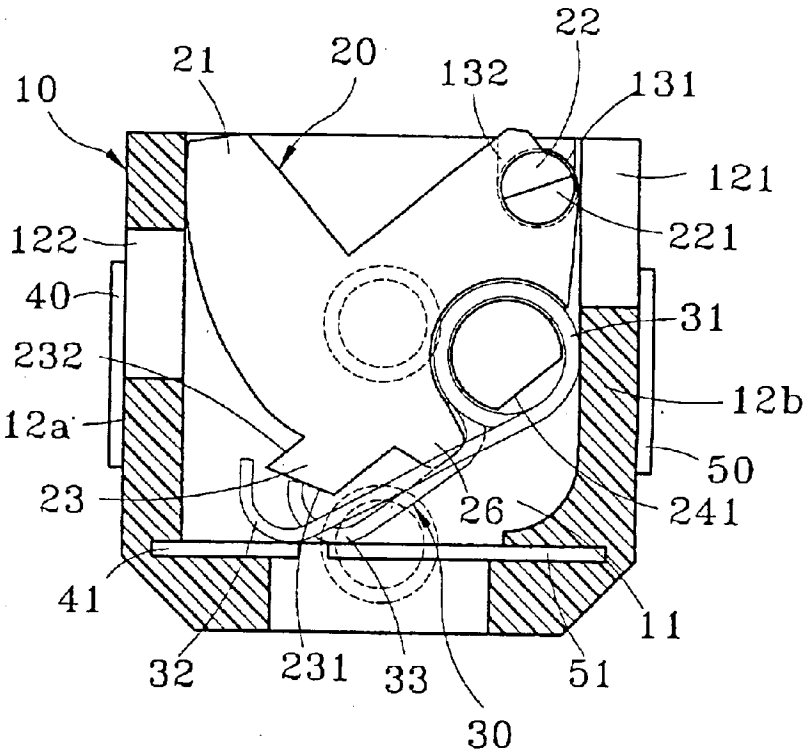
Figure 6B:
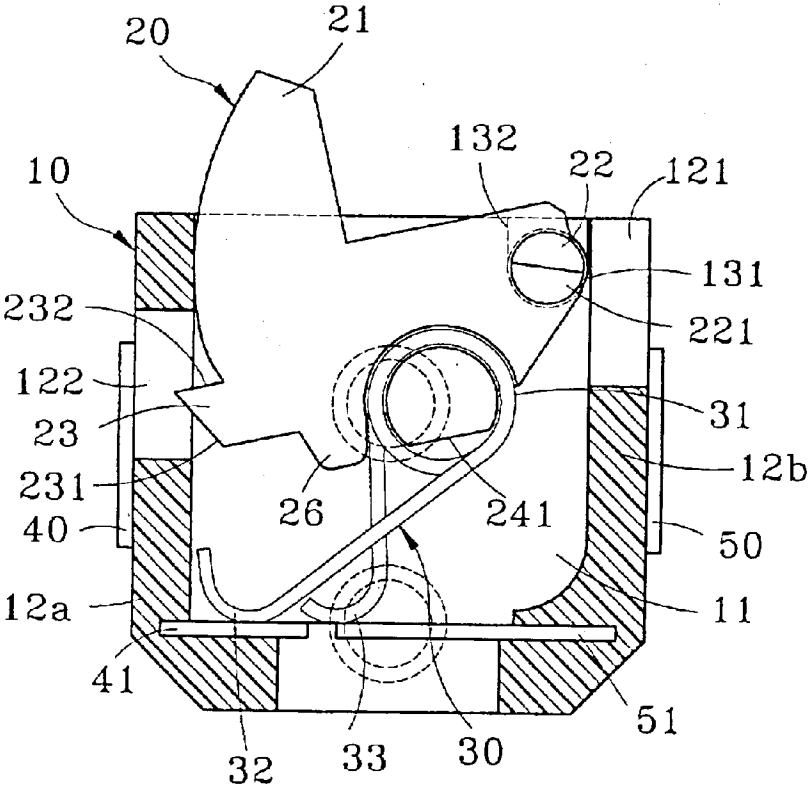

Furthermore, referring to FIGS. 5B and 6B, the following description is to explain the on/off status of electrical contact point when it is in use after assembly. The resilient element 30 of the invention is a coil spring, and a conjoining portion 31 is formed between the first conductive portion 32 and the second conductive portion 33 of the resilient element 30. Besides, a positioning portion 24 used for conjoining to the resilient element 30 is provided in the concave slot 25 of the pushbutton 20 corresponding to the conjoining portion 31, wherein a straight-lined confining edge 241 is provided at the lower part of positioning portion 24, which makes the positioning portion 24 a non-circle shape. When the pushbutton 20 is receiving external force and taking the pivot point 22 as an axis and therefore moving downwards, the first conductive portion 32 of resilient element 30 often keeps in a contact manner with the first contact portion 41 of first conductive terminal 40 extending to the acceptance room 11. On the other hand, a pressing portion 26 corresponding to the pushbutton 20 will apply downward force on the second conductive portion 33 so that the second conductive portion 33 will move downwards to touch the second contact portion 51 of second conductive terminal 50 extending to the acceptance room 11 in order that the electrical contact point can keep on conducting. FIGS. 5C and 6C are mainly to disclose that the receiving force of pushbutton 20 has reached the minimum point of activation interval. Comparing FIGS. 5C and 6C to FIG. 3, it is obvious that since the pushbutton 20 can be free from any obstacle and limitation, the pivot point 22 can then rotate freely, allowing the force-receiving portion 21 of pushbutton 20 to enter the acceptance room 11 completely so as to achieve the design of longer activation interval. In addition, the resilient element 30 and pushbutton 20 of the invention can be placed into the acceptance room 11 to be conjoined to the main body 10 without any tool. Therefore, not only has the structure of the invention been simplified, but the micro switch also will not bring in manufacturing and assembling problems caused by over-diminished volume. Thus, the micro switch of the invention can actually increase activation interval of pushbutton 20 as well as can be assembled and manufactured easily.

What is claimed is:

1. A micro switch, including: first, a main body, wherein an acceptance room is formed therein; second, a first conductive terminal and a second conductive terminal, which are separately provided on the sidewalls of main body; third, a pivot point located inside the acceptance room capable of freely rotating to support a pushbutton on the main body; fourth, a force-receiving portion of pushbutton located at the lower side of pushbutton to provide resilience capable of pushing up the pushbutton protruding from the main body to form the pushbutton; and finally, a resilient element of first and second conductive portions that contacts first and second conductive terminals separately; the features of micro switch are described as below:

a round hole is provided on two sides of the main body corresponding to the pivot point of pushbutton, and a place-in slot is provided extending from the round hole to the opening end of acceptance room; besides, a gap is provided on the sidewall of main body adjacent to the round hole, extending to the opening end of the acceptance room; in addition, a guiding slanting face is formed at the lower edge of pivot point of pushbutton; through flexible force formed by the gap and through the guiding slanting face that makes it easy for the pivot point of pushbutton to be conjoined to the round hole smoothly, a micro switch with longer activation interval is then completed.

2. The micro switch as claimed in claim 1, wherein a confining portion is provided at the other sidewall of main body opposite to the gap; also, a top-ending portion is provided extending from the main body corresponding to the confining portion, wherein the top-ending portion includes a place-in face and a press-top face.

3. The micro switch as claimed in claim 1, wherein a conjoining portion is formed between the first conductive portion and the second conductive portion of the resilient element; besides, a positioning portion to be conjoined to the resilient element is provided in a concave slot on the pushbutton corresponding to the conjoining portion.

4. The micro switch as claimed in claim 3, wherein a straight-lined confining edge is provided at the lower part of positioning portion, which makes the positioning portion of a non-circular shape.

5. The micro switch as claimed in claim 1, wherein the first conductive portion of resilient element is often in contact with a first contact portion of first conductive terminal extending to the acceptance room; in addition, a pressing portion provided corresponding to the pushbutton will apply downward force on the second conductive portion so that the second conductive portion will move downwards to touch a second contact portion of second conductive terminal extending to the acceptance room.

6. The micro switch as claimed in claim 1, wherein the resilient element is a coil spring.

7. A micro switch, including: first, a main body, wherein an acceptance room is formed therein; second, a first conductive terminal and a second conductive terminal, which are separately provided on the sidewalls of main body; third, a pivot point located inside the acceptance room capable of freely rotating to support a pushbutton on the main body; fourth, a force-receiving portion of pushbutton located at the lower side of pushbutton to provide resilience capable of pushing up the pushbutton protruding from the main body to form the pushbutton; and finally, a resilient element of first and second conductive portions that contacts first and second conductive terminals separately; the features of micro switch are described as below:

a confining portion is provided at one sidewall of the main body; also, a top-ending portion is provided extending from the main body corresponding to the confining portion, which includes a place-in face and a press-top face; after that the place-in face of top-ending portion has entered into the confining portion and that a positioning has formed by the press-top face, the pushbutton can then be prevented from detaching while the resilient element is restoring its resilience.

* * * * *